US008661757B2

(12) United States Patent
Miller

(10) Patent No.: US 8,661,757 B2
(45) Date of Patent: Mar. 4, 2014

(54) 30-MINUTE RESIDENTIAL FIRE PROTECTION OF FLOORS

(75) Inventor: Gary F. Miller, Palatine, IL (US)

(73) Assignee: United State Gypsum Company, Chicago, IL (US)

( * ) Notice: Subject to any disclaimer, the term of this patent is extended or adjusted under 35 U.S.C. 154(b) by 126 days.

(21) Appl. No.: 13/069,445

(22) Filed: Mar. 23, 2011

(65) Prior Publication Data

US 2012/0240504 A1 Sep. 27, 2012

(51) Int. Cl.
*E04B 9/00* (2006.01)
*E04G 23/00* (2006.01)

(52) U.S. Cl.
USPC ..... 52/506.07; 52/506.06; 52/741.3; 52/747.1

(58) Field of Classification Search
USPC ..... 52/506.01, 506.05, 506.06, 508, 509, 52/512, 741.3, 745.05, 747.1, 747.11, 52/506.07
See application file for complete search history.

(56) References Cited

U.S. PATENT DOCUMENTS

| | | | | |
|---|---|---|---|---|
| 1,372,478 | A * | 3/1921 | Bradley | 244/117 R |
| 2,286,976 | A | 6/1942 | Roberts | |
| 2,710,679 | A * | 6/1955 | Bibb et al. | 403/217 |
| 2,990,921 | A | 7/1961 | Wilde | |
| 3,153,304 | A * | 10/1964 | Evangelista | 52/144 |
| 3,246,432 | A * | 4/1966 | Young, Jr. | 52/98 |
| 3,315,424 | A * | 4/1967 | Smith | 52/206 |
| 3,399,915 | A * | 9/1968 | Stanzak | 403/219 |
| 3,722,933 | A | 3/1973 | Nute, Jr. | |
| 3,740,912 | A | 6/1973 | Sauer et al. | |
| 3,802,149 | A * | 4/1974 | Armstrong | 52/747.1 |
| 3,977,144 | A | 8/1976 | Jahn | |
| 4,000,594 | A | 1/1977 | Kirk, Jr. | |
| 4,011,707 | A | 3/1977 | Nute, Jr. | |
| 4,114,327 | A * | 9/1978 | Williams | 52/28 |
| 4,206,578 | A * | 6/1980 | Mieyal | 52/506.07 |
| 4,257,205 | A | 3/1981 | Kuhr | |
| 4,275,541 | A | 6/1981 | Orals et al. | |

(Continued)

FOREIGN PATENT DOCUMENTS

| | | | | |
|---|---|---|---|---|
| DE | 3405598 A1 * | 8/1985 | | E04C 2/26 |
| GB | 2452492 A | 3/2009 | | |

OTHER PUBLICATIONS

Notification of Transmittal of the International Search Report and the Written Opinion of the International Searching Authority, or the Declaration of PCT/US2012/028725, filed Dec. 3, 2012, International Search Report and Written Opinion of the International Searching Authority.

*Primary Examiner* — Brian Glessner
*Assistant Examiner* — Joseph J Sadlon
(74) *Attorney, Agent, or Firm* — Pearne & Gordon LLP

(57) ABSTRACT

A fire protective barrier for a residential floor and a method of its construction, the construction involving a floor supported on lightweight joists of a type susceptible to early failure once exposed to a fire existing in the space below the floor, an array of elongated steel main tees suspended below the joists, the tees being parallel and spaced apart by a nominal distance of 2', the tees having an upper hollow reinforcing bulb, a central vertical web extending downwardly from the bulb and a horizontal flange extending laterally from both sides of the web, drywall panels carried on upper faces of the flanges of adjacent pairs of tees, the drywall panels having a width of slightly less than the center-to-center distance of the tees, a majority of the panels having lengths of 8' or more.

7 Claims, 3 Drawing Sheets

(56) References Cited

U.S. PATENT DOCUMENTS

| | | | | | |
|---|---|---|---|---|---|
| 4,727,700 | A | * | 3/1988 | Eberle | 52/417 |
| 4,769,965 | A | | 9/1988 | Shaub | |
| 4,862,662 | A | * | 9/1989 | Eberle et al. | 52/299 |
| 4,926,607 | A | * | 5/1990 | Platt et al. | 52/506.07 |
| 4,995,605 | A | | 2/1991 | Conville | |
| 5,119,612 | A | | 6/1992 | Taylor et al. | |
| 5,364,053 | A | * | 11/1994 | Rodgers | 248/302 |
| 5,406,763 | A | * | 4/1995 | Al-Saleh | 52/311.1 |
| 5,509,241 | A | * | 4/1996 | Coconis et al. | 52/232 |
| 5,572,844 | A | * | 11/1996 | Stackenwalt et al. | 52/506.07 |
| 5,761,869 | A | * | 6/1998 | Tinen et al. | 52/506.07 |
| 5,761,872 | A | * | 6/1998 | Sanford et al. | 52/694 |
| 5,802,800 | A | * | 9/1998 | Meyers | 52/847 |
| 5,943,838 | A | | 8/1999 | Madsen et al. | |
| 5,956,916 | A | | 9/1999 | Liss | |
| 6,139,667 | A | * | 10/2000 | Sanford et al. | 156/92 |
| 6,260,322 | B1 | * | 7/2001 | Lindsay | 52/474 |
| 6,301,854 | B1 | | 10/2001 | Daudet et al. | |
| 6,374,564 | B1 | | 4/2002 | Fletterick et al. | |
| 6,418,694 | B1 | | 7/2002 | Daudet et al. | |
| 6,691,478 | B2 | | 2/2004 | Daudet et al. | |
| 6,722,098 | B2 | | 4/2004 | Platt | |
| 6,761,005 | B1 | | 7/2004 | Daudet et al. | |
| 7,021,606 | B2 | | 4/2006 | Raycraft | |
| 7,240,459 | B2 | | 7/2007 | Daudet et al. | |
| 7,240,460 | B2 | | 7/2007 | Platt | |
| 7,278,243 | B2 | | 10/2007 | Jones et al. | |
| 7,572,328 | B2 | | 8/2009 | Lettkeman et al. | |
| 7,716,899 | B2 | | 5/2010 | Beck et al. | |
| 7,779,593 | B2 | | 8/2010 | Jahn et al. | |
| 7,805,904 | B2 | * | 10/2010 | Clark et al. | 52/506.06 |
| 7,856,786 | B2 | | 12/2010 | Beck et al. | |
| 8,178,449 | B2 | * | 5/2012 | La Vietes et al. | 442/136 |
| 8,561,373 | B1 | * | 10/2013 | McDonald | 52/846 |
| 2004/0182022 | A1 | * | 9/2004 | Stackenwalt et al. | 52/222 |
| 2005/0166524 | A1 | | 8/2005 | Attalla | |
| 2006/0010812 | A1 | | 1/2006 | Jones et al. | |
| 2006/0070319 | A1 | | 4/2006 | Flynn | |
| 2006/0144009 | A1 | | 7/2006 | Attalla | |
| 2008/0236068 | A1 | | 10/2008 | Jahn et al. | |
| 2008/0299680 | A1 | | 12/2008 | Anthony et al. | |
| 2009/0139176 | A1 | * | 6/2009 | Schroeder et al. | 52/656.1 |
| 2010/0037546 | A1 | | 2/2010 | Beck et al. | |
| 2010/0257807 | A1 | * | 10/2010 | Raheel et al. | 52/506.07 |
| 2010/0278687 | A1 | | 11/2010 | Mason | |
| 2011/0061336 | A1 | * | 3/2011 | Thomas | 52/745.19 |
| 2011/0078968 | A1 | * | 4/2011 | Ferrell et al. | 52/506.05 |
| 2012/0167513 | A1 | * | 7/2012 | Ahren | 52/506.07 |

* cited by examiner

30-MINUTE RESIDENTIAL FIRE PROTECTION OF FLOORS

BACKGROUND OF THE INVENTION

The invention relates to building construction and, in particular, to a method and materials for inexpensively fireproofing floor joists.

PRIOR ART

Recent experience has revealed that uncovered lightweight joist construction in residential properties, while adequate in ordinary circumstances, may be susceptible to early structural failure in the event of a fire. This circumstance poses a severe risk to occupants and to firemen or other rescuers who might walk onto a floor area compromised by a fire below and fall through the weakened area. There exists a need for a practical, inexpensive way of protecting lightweight joists to extend the time that they can withstand a fire occurring below. Sprinkler systems are expensive to install, require periodic maintenance and testing and are susceptible to freezing. A conventional drywall ceiling requires taping and eliminates ready access to the joist space for inspection, repair and alteration of utilities, or other purposes. Lightweight joist construction typically involves engineered wood joists. These engineered wood joists, most commonly, are in the form of a wood I-beam having an OSB web and lumber flanges, or a parallel chord truss made of metal plate connected lumber elements.

SUMMARY OF THE INVENTION

The invention provides a method and system for protecting residential floors, for a limited time, from a fire originating below the floor. The invention utilizes conventional materials in a novel manner to achieve a level of protection at relatively low cost while affording additional benefits.

More specifically, the invention combines certain suspended ceiling grid components with fire-rated drywall panels to construct a fire barrier layer or ceiling. The fire barrier layer protects lightweight floor joists from the heat and flames of a fire existing below the floor. The barrier layer can afford protection for a period of time of, for example, 30 minutes.

The drywall panels of the system are carried on main tee runners arranged in parallel on 2 foot centers as contrasted from typical four foot centers of a conventional ceiling construction. The panels are supplied at or are field cut to a width slightly under the 2 foot dimension so that they fit between adjacent runners. Unlike the practice in conventional ceilings, where a grid is established with numerous cross tees or runners between main runners, few if any cross runners are used in the practice of the invention. Also, unlike conventional suspended ceiling construction, the drywall panels are supplied in lengths of 8, 10 or 12 feet, for example. This panel length eliminates the use of most if not all cross runners, depending on the dimensions of the floor area being protected.

Where a dimension of the floor area is longer than a panel, a cross tee can be used between the ends of two panels. This technique eliminates the need to tape what would otherwise be an exposed joint between these panels. Where the plane of the barrier layer is penetrated by utilities, a panel can be cut across a transverse line that is tangent to the penetration, and a cut-out can be made for the penetrating object. A cross tee can be used to support the panel at the transverse cut.

From the foregoing, it will be seen that the invention provides an economical fire barrier layer using conventional materials with minimal material and labor costs. The barrier layer can reduce sound transmission to the space above the protected floor. The drywall panels as well as the grid runners can be painted after they are installed. Whether painted or not, the panels can improve light reflectance in the space below the fire barrier layer.

DESCRIPTION OF THE PREFERRED EMBODIMENTS

Figure 1:
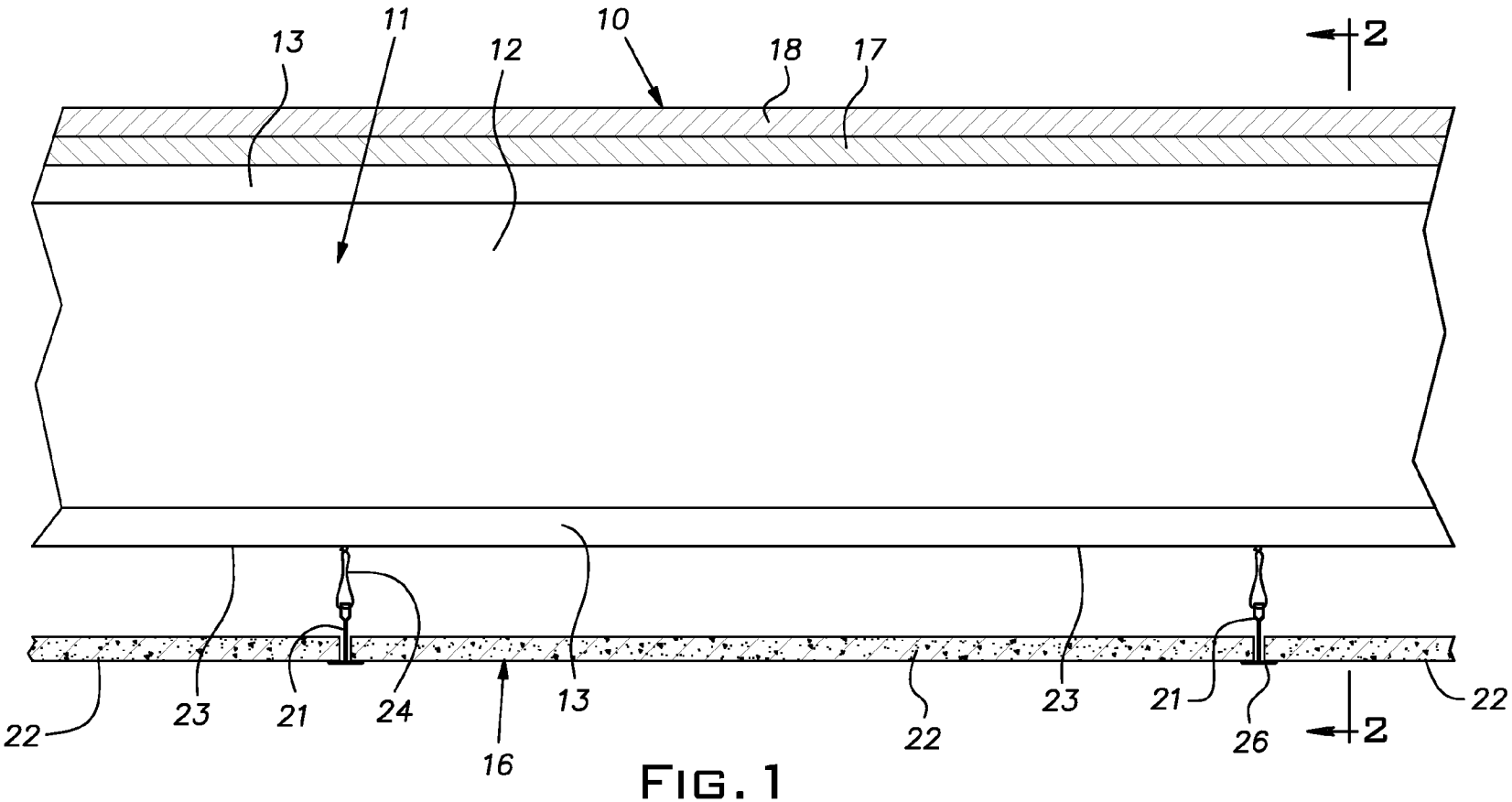
FIG. 1 is a fragmentary cross-sectional view through a residential floor and a fire barrier layer of the invention taken in a plane parallel to a floor joist.
Figure 2:
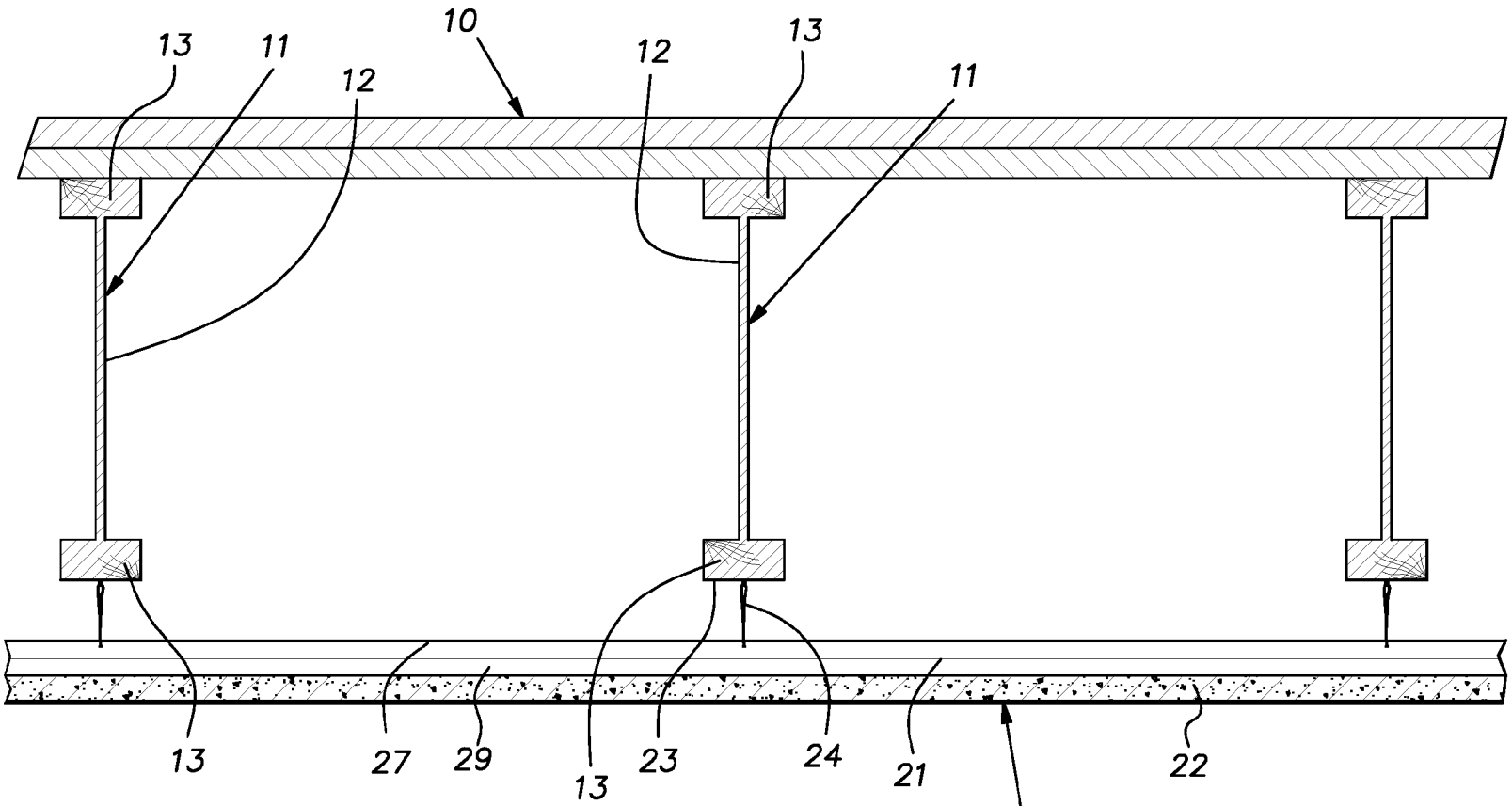
FIG. 2 is a fragmentary view of the floor and fire barrier layer taken in the plane 2-2 indicated in FIG. 1.

Shown in FIGS. 1 and 2 is a typical residential floor construction 10 utilizing lightweight wood joists 11. In the illustrated example, the joists 11 are wood I-beams typically having an oriented stranded board (OSB) webs 12 and sawn lumber flanges 13. Other lightweight wood I-beams, not illustrated, can have their webs factory made with openings spaced along their lengths for ductwork or other utilities. Lightweight wood joists can also be of the parallel chord truss type with its parts of lumber joined by barbed metal plates.

Wood lightweight joists as described have many recognized advantages over solid sawn lumber but can, unfortunately, have a serious disadvantage in the event they are exposed to a fire from below for a relatively short period. Some studies have shown lightweight wood joists failing after only 6 minutes as compared to 30 minutes with conventional solid sawn wood joists.

The invention provides a low cost fire barrier to protect a residential floor from early destruction when exposed to a fire from below. A typical situation where a fire could quickly involve floor joists in a basement of a residence exists where the joists are not covered with a finished ceiling.

The fire barrier layer of the invention utilizes standard building materials and components to minimize cost, complexity and installation labor. The invention uses basic suspended ceiling grid members, but departs from the norm by eliminating, for the most part, a rectangular grid. Instead, where penetrations are not required, only main runners are regularly used and cross runners are only used when the width of a room or section of a basement is too large to be spanned by a single panel of the invention, normally 8, 10 or 12 foot in length.

Referring to FIGS. 1 and 2, a fire barrier 16 is erected under the residential floor 10. The residential floor construction, in addition to the joists 11, typically comprises a sub-floor 17 and a finish floor 18, one or both of which are typically wood-based. The fire barrier or layer 16 comprises two primary components, namely, main runners 21 and drywall panels 22. The main runners 21 are conventional suspended ceiling grid tees. The main runners or tees 21 are suspended on the joists 11 by attachment at spaced intervals along the tees, typically on 4' centers.

An inexpensive way of attaching the tees 21 to the joists 11 is to set a nail into a lower face 23 of a joist, loop a conventional hanger wire around the nail, and then bend the nail over to lock the wire with a nail. The suspension wire, shown at 24, is looped through one of the preformed holes in a bulb 27 or web 29 between the bulb and a lower flange 26 of the grid tee 21 and is then twisted on itself in a conventional manner to fix the tee at a desired elevation. A spacing of 3 or 4 inches from the lower face 23 of a joist 11 to the lower flange 26 of a tee 21 is preferred. This spacing enables a tilted panel 22 with dimensions discussed below to be assembled between adjacent grid runners 21 from below the plane of the runners.

If desired, metal clips can be designed to be attached to the joists 11 and to be snapped onto the bulbs, designated 27, of the tees or runners 21. Another approach is to screw the tees 21 to sheet metal brackets attached to the joists 11. In the illustrations of FIGS. 1 and 2, the tees 21 are suspended in directions perpendicular to the joists 11. Alternatively, the tees 21 can be suspended in parallel alignment with the joists 11. Stringers or other means may be attached to the joists 11 to account for a different center-to-center spacing of the joists 11 from the preferable 2' center spacing of the tees 21.

Figure 3:
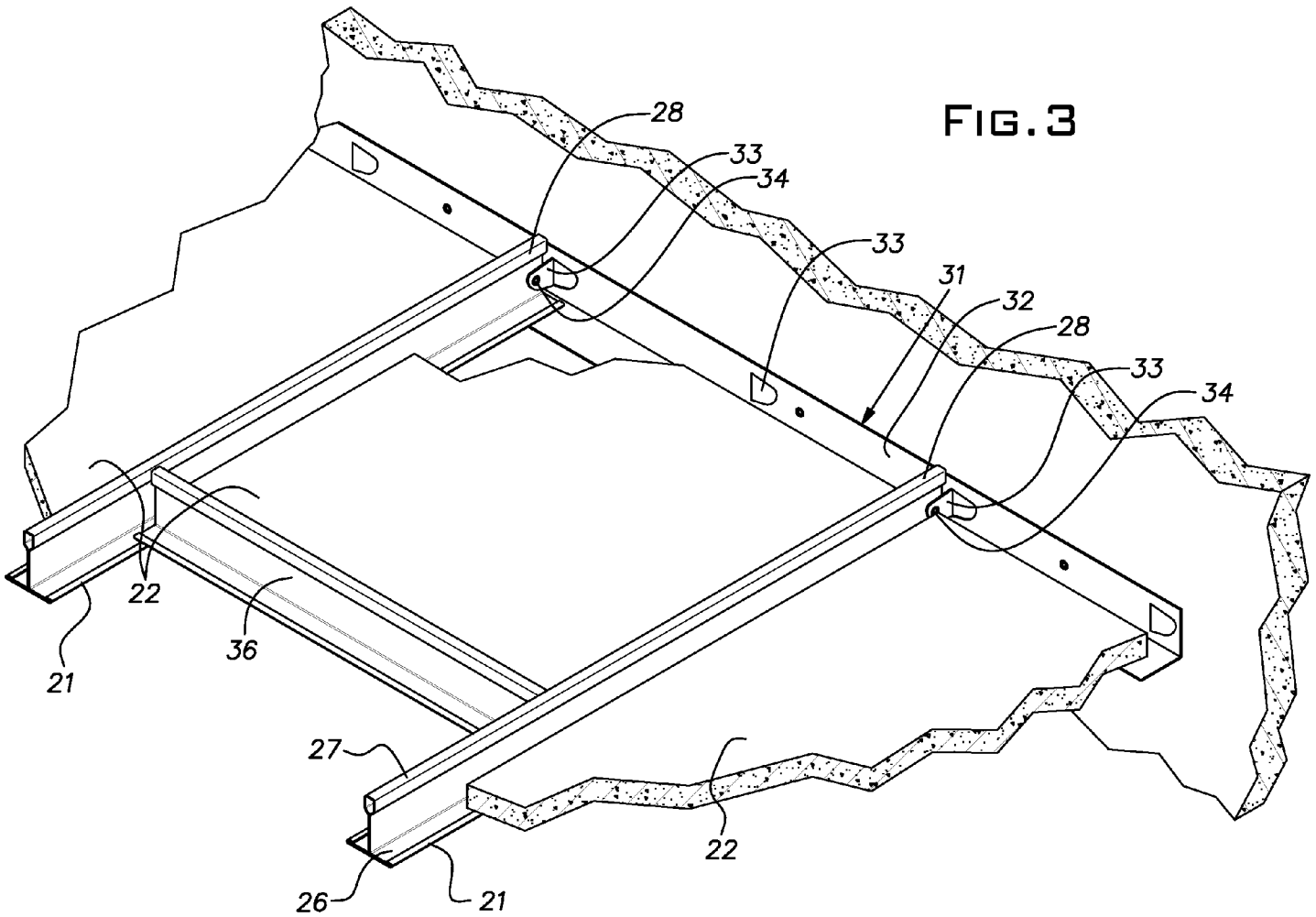
FIG. 3 is an isometric fragmentary view of the fire barrier layer at a perimeter wall.

FIG. 3 illustrates an aspect of the invention relating to support of ends 28 of the tees 21 at a perimeter of the fire barrier 16 or at intermediate areas of the fire barrier where, for example, the floor joists 11 are supported by an underlying cross beam. The tee ends 28 are supported by special wall angles 31. The wall angles 31 are similar to conventional wall angles, being roll-formed of steel sheet stock. Vertical legs 32 of the wall angles 31 can be punched with tabs 33 on, for example, 6" or 12" spaced centers. The tabs 33 can be bent out of the plane of the vertical leg by the installer of the wall angle. Displaced tabs 33 anchor ends 28 of the tees 21 with self-tapping screws 34 driven through both the tabs and the runners 21.

Fireproof drywall is commercially available in sheet form having dimensions of 4'×8', 10', 12' or even longer. While a standard fireproof drywall sheets can be used to practice the invention, such sheets are slightly too wide to be conveniently cut into panels having widths of 23¾" wide. Moreover, standard drywall sheets have tapered edges along their long dimensions. The fire barrier panels 22 of the invention are more conveniently made by splitting fireproof drywall sheets specially made with a width of 47½" and without tapering.

Such drywall sheets when split in half, normally at the installation site, yield panels that are 23¾" wide and are ideal for suspending on the conventional tees 21 fixed at 2' centers. These special width fireproof drywall sheets can have standard 8, 10 or 12' lengths.

With the main runners or tees 21 suspended in place, the drywall panels 22 can be assembled onto the tees. This is accomplished by tilting one long edge of a panel up into the space between a pair of adjacent tees 21 as far as possible so that the lower opposite edge of the panel can be raised past the flange 26 of the close by tee and then shifted back onto the bypassed flange. Following this, the upward edge can be lowered in place. This assembly maneuvering of the panel 22 is analogous to that typically used when installing suspended ceiling tile on ceiling grid.

Manufacturing facilities for producing dimensional fire-rated ⅝" drywall can be easily modified to make the slightly narrower non-tapered 47½" wide preferred panels 22. Standard main tees are joined end-to-end where a floor dimension is larger than say 12'.

Where sections of a basement or area under a floor are larger in dimensions than available with a panel, e.g. beyond 8, 10, or 12', a cross tee 36 (FIG. 3) can be used at the end of a panel to bridge the joint with another panel continuing in the longitudinal direction. The cross tee 36 is assembled between the main tees 21 and can rest on their respective flanges 26. Standard end connectors on the cross tees 36 are unnecessary if there is no need to assemble and lock the connectors in the usual cross tee receiving slots provided in the main runner tees.

Where objects such as pipes and ducts penetrate the plane of the barrier layer 16, a panel can be cut such that it has an edge that is tangent to and cut out for the object. A cross tee can be used to bridge the joint between the cut edge and a complementary panel on a side of the object opposite that of the first panel. The fireproof drywall panels 22, and optionally for expediency, the tees 21 can be painted. This will improve the light reflectance of the panels 22 over their natural reflectance. The fire barrier 16 moreover serves to reduce transmission of sound from the basement area to the space above the floor construction 10.

It should be evident that this disclosure is by way of example and that various changes may be made by adding, modifying or eliminating details without departing from the fair scope of the teaching contained in this disclosure. For example, in geographic regions where metric units are prevalent, the dimensions given above are convertible to their metric equivalents. The invention is therefore not limited to particular details of this disclosure except to the extent that the following claims are necessarily so limited.

What is claimed is:

1. In a residential structure, a construction comprising a floor supported on and extending between lightweight factory-made wood I-beam joists, the floor joists as a result of their lightweight construction being susceptible to early failure once exposed to a fire existing in the space below the floor, an array of elongated steel main tees suspended from and below the joists, the tees being parallel and spaced apart by a nominal center-to-center distance of 2', the tees having an upper hollow reinforcing bulb, a central vertical web extending downwardly from the bulb and a horizontal flange extending laterally from both sides of the web, elongated fire rated drywall panels having longitudinal marginal edges carried on and exclusively above upper faces of the flanges of adjacent pairs of the tees, the elongated fire rated drywall panels having a width of slightly less than the center-to-center distance of the tees, a majority of the elongated fire rated drywall panels having lengths of 8' or more, the fire rated drywall panels providing a fire barrier capable of resisting a fire below the panels for at least thirty minutes.

2. The construction as set forth in claim 1, wherein the tees extend across an area having a dimension greater than the length of a single fire rated drywall panel and an additional panel arranged end to end with the first mentioned panel.

3. The construction as set forth in claim 2, wherein a cross tee is disposed between the ends of the tandem drywall panels to bridge the joint area between said ends.

4. The construction as set forth in claim 1, including a wall angle at the perimeter of the space protected by the drywall panels, the wall angle having a bendable tab punched out of a vertical leg of the wall angle.

5. The construction as set forth in claim 4, wherein the tees are attached to respective ones of the bendable tabs with self-tapping screws.

6. A method of protecting lightweight factory made wood I-beam floor joists from a fire in the space below comprising suspending standard main tees from the joists in parallel and on 2' centers, positioning the tees spaced from the bottom of the joists with space to allow panels of a width of about 23¾ inch to be tilted up and shifted laterally into the space between adjacent tees from below and then downwardly and shifted laterally into position on the flanges of the tees, installing elongated fire-rated drywall panels, whereby the fire rated drywall panels of a length of 8' or greater with a width of about 23¾" on top of the flanges of the tees protect the lightweight factory made wood I-beam floor joists from a fire for at least thirty minutes.

7. The method as set forth in claim 6, wherein the space subtended by the joists being protected and the length of runs of the main tees are longer than the length of a single drywall panel, a cross tee is positioned between the main tees at a joint between two drywall panels.

* * * * *

UNITED STATES PATENT AND TRADEMARK OFFICE

CERTIFICATE OF CORRECTION

PATENT NO. : 8,661,757 B2
APPLICATION NO. : 13/069445
DATED : March 4, 2014
INVENTOR(S) : Gary F. Miller It is certified that error appears in the above-identified patent and that said Letters Patent is hereby corrected as shown below:

On the Title Page, Item (73) Assignee, please change "United State Gypsum Company" to --United States Gypsum Company--.

Signed and Sealed this
Tenth Day of June, 2014

Michelle K. Lee

Michelle K. Lee
*Deputy Director of the United States Patent and Trademark Office*